US007128935B2

(12) United States Patent
Germick et al.

(10) Patent No.: US 7,128,935 B2
(45) Date of Patent: Oct. 31, 2006

(54) METHOD FOR MAKING A PATTERNED FOOD PRODUCT

(75) Inventors: Robert J. Germick, Plymouth, MN (US); Scott F. Gillespie, Golden Valley, MN (US); Jennifer M. Maack, Alexandria, MN (US); Leslie D. Miller, Mendota, IL (US); Jonathan P. Paul, Mound, MN (US); Amanda Clare Hume Stewart, Winslow, IN (US)

(73) Assignee: General Mills, Inc., Minneapolis, MN (US)

( * ) Notice: Subject to any disclaimer, the term of this patent is extended or adjusted under 35 U.S.C. 154(b) by 373 days.

(21) Appl. No.: 09/904,794

(22) Filed: Jul. 12, 2001

(65) Prior Publication Data

US 2003/0009987 A1 Jan. 16, 2003

(51) Int. Cl.
*A23L 1/275* (2006.01)
*A23C 9/123* (2006.01)
*A23C 9/13* (2006.01)

(52) U.S. Cl. ..... 426/250; 426/249; 426/583; 141/9; 141/100; 141/105; 222/145.3

(58) Field of Classification Search ..... 141/9, 141/100, 105, 267, 268, 270; 222/145.3; 426/101, 249, 583, 250
See application file for complete search history.

(56) References Cited

U.S. PATENT DOCUMENTS 1,951,694 A * 3/1934 Goulstone
2,227,236 A 12/1940 Vogt
2,284,651 A * 6/1942 Gundlach et al.
2,313,060 A * 3/1943 Friedman
2,334,052 A * 11/1943 Wedin
2,646,757 A * 7/1953 Hackmann
2,669,945 A * 2/1954 Wildebour
2,758,553 A * 8/1956 Moser
2,774,314 A * 12/1956 Moser
2,828,591 A 4/1958 Bossche
2,893,605 A * 7/1959 Anderson
3,129,673 A 4/1964 Stanley (Continued)

FOREIGN PATENT DOCUMENTS

JP 87-190043 8/1987

(Continued)

*Primary Examiner*—Steve Weinstein
(74) *Attorney, Agent, or Firm*—Alan Kamrath; John O'Toole; Annette Frawley

(57) ABSTRACT

A food product, preferably a food ingredient in the form of dye, pigment or similar colorant in a random pattern in refrigerated yogurt, is produced by supplying the food ingredient through a supply tube (82) extending through an injection tube (80) and into a fill pipe (78) and a fill tube (28). In the preferred form, an elongated tubular member is formed around the fill tube (28) from a strip (20) of flexible material, with top and bottom seals being formed by a forming station (36). In the preferred form, the injection tube (80) extends at an angle to the fill pipe (78) such that the supply tube (82) formed of stainless steel is generally linearly straight. The fill pipe (78) includes seal flanges (78*a*, 78*b*) allowing its removal from the food material supply tubing (68) and the fill tube (28) to allow conventional cleaning of the remaining components of the apparatus (10). The streaking effect is increased by introducing the second food ingredient through first and second ducts (85) on diametric opposite sides of and axially spaced along supply tube (82) and extending at an acute angle upstream of the supply tube (82).

32 Claims, 1 Drawing Sheet

U.S. PATENT DOCUMENTS 3,256,673 A 6/1966 Tew et al.
3,267,971 A * 8/1966 Mueller
3,269,842 A 8/1966 Mayer et al.
3,286,433 A 11/1966 Johnson et al.
3,347,287 A * 10/1967 Geber
3,452,505 A 7/1969 Hoag
3,479,426 A * 11/1969 Morshavser et al.
3,482,373 A 12/1969 Morris
3,509,920 A * 5/1970 Word
3,559,700 A * 2/1971 Erickson
3,581,457 A 6/1971 Gerlach et al.
3,599,538 A 8/1971 Piazza
RE27,302 E 2/1972 Schneider et al.
3,657,856 A 4/1972 Planner
3,760,559 A 9/1973 Heinzer
3,861,121 A 1/1975 Monsees
3,886,973 A * 6/1975 Kinney
3,921,367 A 11/1975 Beaurain
3,924,383 A 12/1975 Heger
3,932,680 A 1/1976 Egli et al.
3,952,782 A 4/1976 Mannara
3,971,853 A * 7/1976 Crowder ..... 426/249
4,015,644 A 4/1977 Kinney
4,035,984 A 7/1977 Gerlach et al.
4,116,369 A * 9/1978 Crowder
4,117,647 A 10/1978 Rossi
4,136,720 A * 1/1979 Kinney
4,159,028 A * 6/1979 Barker et al.
4,184,613 A * 1/1980 Kinney
4,223,043 A 9/1980 Johnson
4,225,623 A 9/1980 Stussi
4,235,934 A 11/1980 Egli et al.
4,410,549 A 10/1983 Baker
4,430,349 A 2/1984 Mulone et al.
4,480,751 A 11/1984 Lueptow
4,485,613 A 12/1984 Saur
4,552,613 A 11/1985 Auer
4,676,051 A 6/1987 Hoskinson et al.
4,738,074 A * 4/1988 Invernizzi et al.
4,797,289 A 1/1989 Reddy
4,837,035 A 6/1989 Baker et al.
4,837,036 A 6/1989 Baker et al.
4,913,561 A 4/1990 Beer
4,921,021 A * 5/1990 Andersson
4,942,910 A * 7/1990 Hamamura
4,947,621 A 8/1990 Christine et al.
4,952,414 A 8/1990 Kaufman et al.
4,964,263 A 10/1990 Ballestrazzi et al.
4,966,205 A * 10/1990 Tanaka
5,037,660 A 8/1991 Driessen et al.
5,118,202 A 6/1992 Bruno
5,155,979 A 10/1992 McDonald
5,231,817 A 8/1993 Sadler
5,235,794 A 8/1993 Center
5,378,483 A 1/1995 Fazio et al.
RE34,905 E 4/1995 Ausnit
5,435,143 A 7/1995 Heinrich
5,447,036 A 9/1995 Heinrich
5,494,692 A * 2/1996 Beyer et al.
5,540,035 A 7/1996 Plahm et al.
5,556,653 A * 9/1996 Binley
5,568,729 A 10/1996 Heinrich et al.
5,596,867 A 1/1997 Davis
5,603,965 A * 2/1997 Daouse
D386,398 S 11/1997 Davis
5,713,186 A 2/1998 Bruhn
5,784,863 A 7/1998 Davis
D399,512 S 10/1998 Davis et al.
5,822,958 A 10/1998 Davis
6,004,606 A * 12/1999 French et al.
6,006,501 A 12/1999 Davis et al.
6,044,875 A * 4/2000 Anderson et al.
6,068,865 A * 5/2000 Lee et al.
6,235,320 B1 5/2001 Daravingas et al.
6,294,213 B1 9/2001 Hashisaka et al.

FOREIGN PATENT DOCUMENTS

JP 64-16553 1/1989

* cited by examiner

METHOD FOR MAKING A PATTERNED FOOD PRODUCT

BACKGROUND

The present invention generally relates to novel food products and apparatus and methods of their production, particularly to food products in the form of a food ingredient in an irregular and random pattern in a food material and their production, and specifically to food products in the form of a dye, pigment or colorant in a tie dye pattern in a refrigerated, thixotropic food material, preferably a cultured dairy product, and most preferably yogurt, and their production.

Food manufacturers are continually attempting to present food products in novel arrangements to enhance the marketing of the food products beyond the food material itself. As an example, such food products can be packaged in a manner that enhances its acceptability for consumption in new situations. Specifically, Yoplait USA, Inc. has marketed refrigerated yogurt filled in a tube package under the GOGURT and EXPRÈSSE trademarks. Such yogurt filled tube package articles can be conveniently consumed without the use of a spoon by simply cutting or tearing the end of the tube and manually squeezing the contents from the tube directly into the consumer's mouth. By virtue of not requiring a spoon for consumption, this food product is more acceptable to many consumers for consumption away from the home such as for carried lunches such as to schools. Additionally, such filled tubes often are easier to be included in lunch containers than conventional rigid cylindrical containers that also require eating utensils. Further, such filled tubes add a play value during the consumption of such food, which enhances the marketability to younger consumers.

Although marketing of yogurt in tubes has experienced considerable market success due to several factors including its uniqueness, ease of consumption without utensils, and the like, there is a continual need to present yogurt and similar food products in further novel arrangements to enhance the marketing of the food material. In this regard, filled tubes are often marketed in a package including multiple food products. It is then desirable that such packages not include multiples of identical products but rather include a variety of products. However, it should be appreciated that the cost of producing multiple types of many products such as yogurt is often prohibitive. Thus, there is a further need to present yogurt and similar food products in a variety of forms and in a manner that avoids the costs and other production problems of producing multiple products.

Furthermore, cleaning of food production equipment is always a concern, but is especially so for food products which require refrigeration such as yogurt. In particular, any food particles which are not removed from the production equipment are subject to spoiling and can result in contamination of the final product by being released in later production runs or by contaminating other food material which reduces its shelf life. Thus, a need exists to insure that food production equipment can be easily cleaned when necessary.

SUMMARY

The present invention solves these needs and other problems in the field of the production of a food product including a food ingredient preferably in the form of a colorant, pigment or dye in an irregular and random pattern in a nonsolid food material, with the food ingredient remaining generally in the irregular and random pattern for the intended shelf life of the food product before intermixing throughout the food material. In the preferred form, the food ingredient is introduced into the food material flowing through a fill tube for filling a flexible wall pouch preferably formed by folding a strip of flexible material around the end of the fill tube. In the preferred form, the food ingredient is introduced through an injection tube intersecting the fill pipe and in the most preferred form is introduced through a supply pipe extending through the injection tube and into the fill pipe. In the most preferred form, an injection manifold is provided including a fill pipe and the injection tube intersecting therewith, with the ends of the fill pipe being removably sealingly connectable to the tubing from the source of food material and to the fill tube, respectively.

Thus, it is an object of the present invention to provide novel apparatus and methods for providing multiple varieties of novel food products.

It is further an object of the present invention to provide such novel apparatus and methods which provide ease of cleaning including utilizing conventional cleaning systems.

It is further an object of the present invention to provide such novel apparatus and methods which can be easily added to and removed from conventional apparatus and preferably without modification to such apparatus.

It is further an object of the present invention to provide such novel apparatus and methods for producing novel, multiple varieties of food products from a single source of food material, and preferably in a preferred form by adding a food ingredient which does not require cooling to a food material which requires refrigeration.

It is further an object of the present invention to provide such novel apparatus and methods for producing novel, multiple varieties of food products from a food material provided with no, one, multiple and/or different combinations of a dye, pigment or colorant.

It is further an object of the present invention to provide such novel apparatus and methods novel food products including a random pattern of a food ingredient in a food material.

It is further an object of the present invention to provide such novel apparatus and methods for producing novel, multiple varieties of a yogurt based food product.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figures 1, 2:
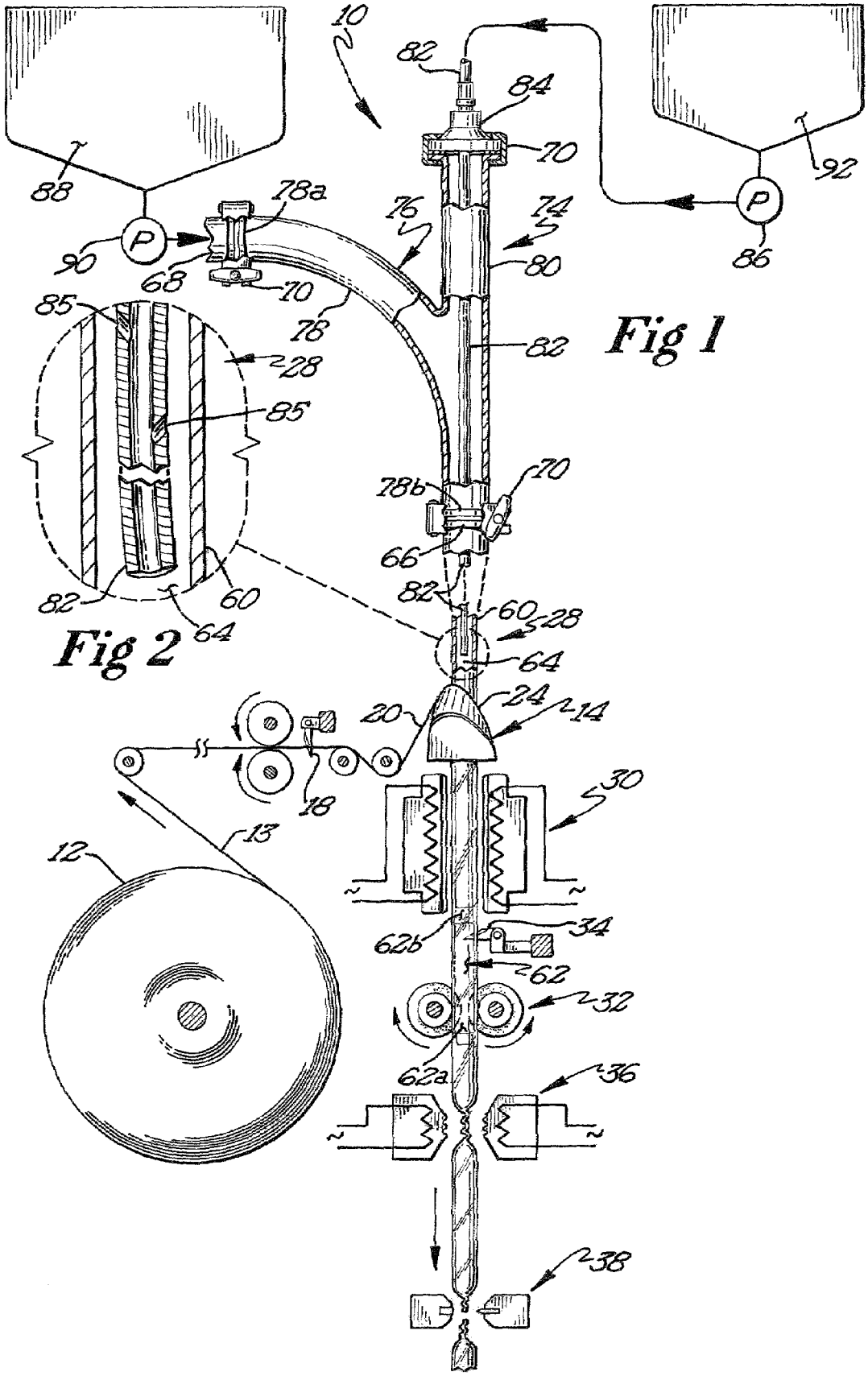
FIG. 1 shows a side view of an apparatus for producing multiple varieties of novel food products utilizing methods according to the preferred teachings of the present invention, with portions broken away to show internal components and portions shown diagrammatically and of significantly reduced size.
FIG. 2 shows an enlarged, partial, sectional view of the apparatus of FIG. 1 within the encircled area of FIG. 1.

All figures are drawn for ease of explanation of the basic teachings of the present invention only; the extensions of the figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "side", "end", "bottom", "first", "second", "inside", "upper", "lower", "outer", and similar terms are used herein, it should be understood that these terms have reference only to the structure shown in the drawings as it would appear to a person viewing the drawings and are utilized only to facilitate describing the illustrative embodiment.

DESCRIPTION

Apparatus for producing food products in the form of a semi-solid or flowable solid, high viscosity, food material, especially those having thixotropic properties, held in a flexible wall pouch and particularly of a food material requiring refrigeration, preferably a cultured dairy product, and in the most preferred form of yogurt according to the preferred teachings of the present invention is shown in the drawings and generally designated 10. In the preferred form, apparatus 10 is a modification of a conventional, vertical form, fill and seal packaging apparatus and in the most preferred form marketed by Winpak Lane, Inc. of San Bernardino, Calif., which is shown in U.S. Pat. No. 6,006,501, which is hereby incorporated herein by reference.

Particularly, apparatus 10 may take any desired shape and can have any size or shape frame. Apparatus 10 provides a web of flexible material 13, such as a heat-sealed plastic from a roll 12. The web of material 13 in the preferred form is slit by a plurality of cutting elements 18 into a plurality of strips 20. Each strip 20 is guided to a forming station 14 having a corresponding open forming area 24 receiving strip 20. Open forming area 24 in the preferred form has an elongated elliptical shaped entrance and an exit shape comprising a pair of exit openings which results in strip 20 being folded into the configuration of an extended FIG. 8 or an infinity sign.

A pair of fill ducts or tubes 28 are provided and pass through each of the open forming areas 24. In particular, each fill tube 28 includes a longer upper portion 60 and a shorter, lower portion 62. A central passage 64 of a constant size and shape of preferably circular cross sections extends through portions 60 and 62 for the entire vertical length of fill tube 28 to provide a flow direction in fill tubes 28 which is vertically oriented. Upper portion 60 has a minimal wall thickness having an outer perimeter of a constant size and shape corresponding to the shape of passage 64. Lower portion 62 terminates in an expanded portion 62*a* having a substantial wall thickness to define an outer perimeter of a constant size which is larger than the diameter of passage 64 and of upper portion 60 and of a shape corresponding to the shape of passage 64. Lower portion 62 has an intermediate portion 62*b* of a frusto-shape having an upper outer perimeter corresponding to that of upper portion 60 and a lower outer perimeter corresponding to that of expanded portion 62*a*. The free end of upper portion 60 includes a radially extending seal flange 66.

Forming station 14 is positioned relative to fill tubes 28 such that upper portion 60 of the pair of fill tubes 28 extend into and through the pair of exit openings of open forming area 24. A side seal station 30 is positioned below forming station 14 and above lower portions 62 for sealing strip 20 centrally of the FIG. 8 shape. A cutting element 34 such as a stationary blade also can be provided at any desired location after seal station 30 for cutting generally centrally of and along the entire length of the side seal to form two, separate, vertically oriented and filled, elongated tubular members each having a single side seal. A pair of drive rollers 32 simultaneously engages and pulls the two separate elongated tubular members through the forming station 14. One or more seal forming stations 36 are provided to form bottom seals on first pouches and top seals on second pouches below the first pouches, with the bottom seal of the upper, unfilled pouch being simultaneously formed with the top seal of the lower, filled pouch utilizing a single pair of sealing jaws in the preferred embodiment. Station 38 is provided as part of or after seal forming stations 36 for cutting off the pouches between the top and bottom seals. It can be appreciated that forming station 14, fill tubes 28, stations 30, 36, and 38, and cutting element 34 can have a variety of configurations and arrangements to form a suitable receptacle for receiving food product which in the most preferred form is of an elongated, tube-like, flexible wall pouch.

Apparatus 10 further includes tubing 68 directing a flow of food material from a source 88 to each fill tube 28. Prior to the present invention, tubing 68 was sealingly connected to seal flange 66 by a releasable clamp 70 of a conventional design. In operation, flow of food material through tubing 68 is intermittingly supplied by a pump 90. Specifically, after the bottom seal is formed, food material is filled in the vertically oriented flow direction through each fill tube 28 into the pouches which are being simultaneously or previously formed by movement of strip 20. After being filled with the desired amount of food material, flow of food material is stopped while the top seals and bottom seals are formed. Thereafter, this process is continuously performed in like manner.

Apparatus 10 according to the preferred teachings of the present invention further includes an injection manifold 74 for adding one or more second food ingredients to the food material flowing through fill tubes 28 where the second food ingredient in the most preferred form is a dye, pigment or similar colorant. Additionally, in the most preferred form, the second food ingredient is introduced into the food material in an irregular and random pattern and remains generally in such irregular and random pattern for the intended shelf life of the food product before intermixing or dispersing throughout the food material. In particular, the food material flowing through tubing 68 is homogeneous and in the most preferred form of an original background color or hue. Generally, in the most preferred form, the food material is a nonsolid, can be thixotropic, and has a high viscosity in the range of 8,000 to 40,000 cps at around 5° C. but which is flowable as a semi-solid or flowable solid, slurries, or the like during packaging. In the preferred form, the food material is a cultured dairy product and most preferably is yogurt. However, food materials can include fruit purees and fruit sauces such as applesauce, pastes, custards, and the like. The second food ingredient is of an inconsistent concentration in the food material and remains so for the intended shelf life of the food product. Thus, the food product is heterogeneous, and in the preferred form, of a color or hue at least slightly different than the original background color or hue and including portions of differing colors and hue approaching that of the second food ingredient.

In more preferred embodiments such as for yogurt products, the colorants are selected to minimize bleeding from the random pattern into the yogurt. In preferred forms, the yogurt further essentially includes second food ingredients comprising selected non-bleeding colorants that minimize color migration between the colored portions and background color portions of the yogurt during quiescent storage. The colorants are selected from FD&C lake pigment, FD&C dyes, natural colors and mixtures thereof. By "non-bleeding" colorant, it is meant herein that the colorant resists rapid migration from the colored portion to the background color portion. Such migration undesirably weakens the color of the colored phase from which the colorant migrates and discolors the phase to which the colorant does migrate. Useful colorant materials herein are non-bleeding colorants including FD&C lake colorants, some natural pigments, and mixtures thereof. Also useful herein are "natural" colorants such as 1) Carminic acid (red colorant) solution in water, alkalized (with ammonium hydroxide, sodium hydroxide or other alkaline agent), containing glycerine, especially preferred is carminic acid desirably adjusted to a pH of above 9.5 to minimize undesired precipitation and below 12, where it has been surprisingly found that more undesirable dye migration can occur and/or 2) Caramel color (brown type colorant) solution. Good results are obtained when the second food ingredient comprises about 0.0 1% to 0.5% preferably 0.05% to 0.25% of the food product. In contrast, bleeding, water-soluble colorants are to be avoided herein since these colorants tend undesirably to migrate between the differently colored yogurt phases. Undesirable bleeding colorants include for example, FD&C water soluble dye color and some natural colors. The skilled artisan will have no difficulty selecting useful colorants, especially since relatively few colorants are legally permissibly added to yogurt. In still another variation, the second food ingredient can also be a differently colored and/or flavored yogurt. (See, for example, U.S. Pat. No. 6,235,320 by Daravingas et al. "Colored Multi-Layered Yogurt and Method of Preparation" which is incorporated herein by reference). In further variations, the second food ingredient can be chocolate or candy sauces or like food ingredients.

Specifically, manifold 74 includes an injection connector 76 for each fill tube 28. Injection connector 76 includes a fill pipe or tube 78 having a constant size and shape corresponding to upper portion 60 of fill tube 28. The upstream and downstream ends of fill tube 78 each includes radially extending seal flanges 78*a* and 78*b*, respectively. For each fill tube 28, first releasable clamp 70 is utilized to sealingly connect seal flange 66 to flange 78*b*, and second releasable clamp 70 is utilized to sealingly connect flange 78*a* to tubing 68. Injection connector 76 includes an injection tube 80 extending at an angle to fill tube 78 and generally linearly straight to the direction of food material flow within and to fill tubes 28. In the most preferred form, injection tube 80 is of a size and shape generally corresponding to fill tubes 28 and 78 and preferably has circular cross sections. In the preferred form shown, fill tube 78 is generally arcuate with injection tube 80 extending tangentially to fill tube 78. However, injection connector 76 may have other shapes according to the teachings of the present invention such as but not limited to a Y-shape which may be advantageous for manufacturing reasons.

Injection connector 76 further includes a second food ingredient supply tube 82 of an elongated length to be inserted through the open end of injection tube 80 and extended into fill tube 28 such that tube 82 is generally vertical in fill tubes 28 and 78 with its free end is located in passage 64 and in the most preferred form extends into upper portion 60. Generally, the more downstream tube 82 extends into fill tube 82 the less mixing of the second food ingredient in the food material occurs while the higher upstream tube 82 terminates, more mixing of the second food ingredient in the food material occurs. Tube 82 has a size and shape considerably smaller than fill tubes 28 and 78 and specifically is of a size which does not adversely affect the flow of food material through fill tubes 28 and 78 when positioned therein. In the most preferred form, supply tube 82 is formed of stainless steel to meet cleaning regulations and as a result can not be bent at large angles approaching perpendicular. It can be appreciated that the linear angle of injection tube 80 relative to fill tube 28 allows insertion of supply tube 82 into fill tubes 28 and 78 without requiring supply tubes 82 to be bent at significant angles. In the most preferred form, tube 82 is generally linear straight but with a slight arch such that the end opening is located adjacent to the inside surface of fill tube 28. Such a positioning introduces the second food ingredient adjacent to an outer edge of the food material to increase the visibility of the second food ingredient within the food material in the food product. Additionally, tube 82 entering fill tube 78 does not present a ledge behind which flow of food material can build up. Such build up is undesirable as such build up can harden and will tend to be periodically released from behind the ledge as a clump when the build up reaches a certain size. Additionally, the tangential relation of injection tube 80 of the preferred form shown also reduces the tendency of food material to flow into injection tube 80 from fill tube 78. However, conventional seals 84 are provided between supply tube 82 and the free end of injection tube 80 to prevent the escape of any food material from injection tube 80 around supply tube 82 and to prevent the entry of contaminates into injection tube 80 around supply tube 82.

Furthermore, in preferred forms, suitable provisions are included in apparatus 10 to increase the streaking effect in the introduction of the second food ingredient into the food material to enhance the irregular and random pattern of the second food ingredient in the food material. Particularly, in a most preferred form, first and second flow ducts 85 are formed in supply tube 82 at an acute angle extending upstream of tube 82. Specifically, ducts 85 in the preferred form are drilled at an angle in the order of 45° in the same diametric plane but on opposite sides of tube 82 and at different axial spacings. Particularly, in the preferred form, first duct 85 is spaced from the end of tube 82 generally eight times its outside diameter while second duct 85 is spaced generally ten times its outside diameter. In the preferred form, tube 82 has an outside diameter of one-eighth inch (0.32 cm) such that the spacing of ducts 85 are one inch (2.54 cm) and one and one quarter inch (3.12 cm) from the end of tube 82. The diameter of ducts 85 are in the order of and in the most preferred form slightly larger than one-half of the inside diameter of pipe 82, and in the preferred form where the inside diameter of pipe is 0.055 inch (0.140 cm), the diameter of ducts are 0.03125 inch (0.079 cm). Generally, the streaking effect provisions increase the amount of the second food ingredient that escapes supply tube 82 during the filling operation. In the preferred form where first and second ducts 85 are provided, structural integrity of supply tube 82 is not sacrificed such that breakage and separation of tube portions are not a significant concern which could be a problem if one duct 85 of a larger size or more than two ducts 85 are provided. Although in the preferred form shown the end opening of tube 82 is of a size equal to the inside diameter, it should be appreciated that the streaking provisions can take other forms including changing the shape and/or size of the end opening of pipe 82, with blocking the end of pipe 82 being considered as undesirable as preventing flow through cleaning without dead space. The geometry of the entry points and particularly of ducts 85 and the end opening of pipe 82 of the preferred form has a greater effect on the streaking effect with increasing thickness of the second food ingredient.

Various factors including the length in which supply tube 82 extends into fill tube 28, the number, size, and geometry of the second food ingredient entry points from tube 82 into fill tube 28, the choice of pump 86 pressurizing the second food ingredient within supply tube 82, and the like affect the amount of mixing of the second food ingredient with the food material flow. In the most preferred form, it is desired that the second food ingredient be in the form of an irregular and random pattern which is inside of the food material rather than being completely intermixed with the food material. It should be further appreciated that the second food ingredient will typically disperse through the food material inside of the pouch after production. The rate of dispersion of the second food ingredient is then a function of the particular food ingredient and food material and the intended time between production and consumption. Additionally, it is believed to be advantageous that if more than one supply tube 82 is provided to any particular fill tube 28, that such supply tubes 82 extend different lengths within fill tube 28 to reduce intermixing of the food ingredients introduced by such separate supply tubes 82 and thereby generally create separate irregular and random patterns inside of the food material. In the most preferred form, it is believed that if more than one supply tube 82 is desired, all supply tubes 82 can pass through seal 84 into the same injection tube 80. However, multiple injection tubes 80 can be provided relative to fill tube 78 in a manner each to receive a separate supply tube 82 without detrimentally bending.

It should be appreciated that apparatus 10 according to the teachings of the present invention is advantageous as multiple varieties of food products can be produced in apparatus 10 with a single source 88 of food material. In particular, prior to the present invention, if a variety of food products were desired, a plurality of sources 88 of different food materials were provided. According to the preferred teachings of the present invention, a single source 88 of food material is provided pressurized by pump 90 into tubing 68, and multiples sources 92 of second, food ingredients such as but not limited to dyes, pigments, and colorants are provided, with food products being provided with no, one, multiple and/or different combinations of second food ingredients being produced. It can be appreciated that second food ingredients such as dyes, pigments and colorants often do not require cooling and can be easily interchanged and thus can be provided more conveniently and less expensively than multiple forms of food material, especially for food materials which are not shelf stable such as those requiring refrigeration such as yogurt. Furthermore, as the patterns of the second food ingredient are irregular and random inside of the food material in the pouch, the appearance of the food products are varied even if a limited number of types of second food ingredients are provided according to the preferred teachings of the present invention.

Prior to the present invention, prior apparatus 10 included cleaning systems that run water or similar cleaning solution through tubing 68 and fill tubes 28. However, it can be appreciated that such conventional cleaning systems may not result in the removal of food particles in tubes 82 and/or 80. Apparatus 10 according to the preferred teachings of the present invention includes injection manifold 74 which is removable. In particular, the sealing connection by clamps 70 between injection connector 76 and tubing 68 and fill tubes 28 can be removed. After connectors 76 have been removed, tubing 68 can be sealingly connected to fill tubes 28 by clamps 70 so that apparatus 10 can be cleaned utilizing conventional cleaning systems while injection connectors 76 and supply tubes 82 can be cleaned manually or by other suitable methods. In this regard, injection manifold 74 according to the preferred teachings of the present invention is arranged and includes suitable frame elements so that all injection connectors 76 and supply tubes 82 can be removed and replaced as a single unit. Another advantage of the present invention is that it is not necessary to structurally modify existing prior apparatus 10 such as by attempting to connect injection tubes 80 to fill tubes 28 which can result in damage thereto because of their relatively fragile nature.

Now that the basic teachings of the present invention have been explained, many extensions and variations will be obvious to one having ordinary skill in the art. For example, although apparatus 10 of the most preferred form produces first and second pouches having a single side seal from a FIG. 8 configuration, it can be appreciated that one or more than two pouches could be formed in a continuous basis, with the pouches being of any desired configuration. Likewise, although in the most preferred form the pouches are at least partially formed around fill tubes 28, apparatus 10 according to the preferred teachings of the present invention may have application to other manners of forming pouches including but not limited to filling preformed pouches and/or to other types of containers.

Thus, since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. Method for producing a food item having an irregular and random pattern of a food ingredient contained therein comprising: flowing a flowable food product through a fill tube in a flow direction; and introducing a food ingredient into the flowing flowable food product in the fill tube though an entry point in the form of a first duct formed in a supply tube spaced from a free end of the supply tube, with the supply tube being formed by an annular wall extending from outside the fill tube to the free end of the supply tube inside the fill tube, and the annular wall having an inner surface and an outer surface spaced from each other by the thickness of the annular wall, said flowing the flowable food product through said fill tube comprising flowing the flowable food product through said fill tube to contact the outer surface of said annular wall of said supply tube; said introducing the food ingredient into the flowable food product comprising flowing the food ingredient within the inner surface of said annular wall of said supply tube, with the first duct creating a channel and extending through the annular wall of the supply tube from the inner surface to the outer surface of the supply tube to provide fluid communication between the supply tube and the fill tube through the thickness of the annular wall of the supply tube; said first duct extending through the annular wall of the supply tube at an acute angle with the longitudinal axis of the supply tube in the upstream direction opposite to the flow direction of said flowable food product; said free end of the supply tube and said first duct formed in said supply tube being located inside of the fill tube, with the supply tube extending into the fill tube in the flow direction of said flowable food product; said supply tube having a cross sectional size considerably smaller than the fill tube so as not to adversely affect the flowable food material flowing through the fill tube; said first duct terminating at the outer surface of said annular wall of said supply tube and not presenting a ledge in the fill tube behind which the flow of food product can build up, said first duct terminating at the inner surface of said annular wall of said supply tube and not blocking the flow of the food ingredient in the supply tube; said introducing the food ingredient comprising flowing the food ingredient through the supply tube in the flow direction of said flowable food product and through the first duct in said annular wall of said supply tube at said acute angle so that said food ingredient is introduced into the flow of flowable food product in said fill tube in a direction opposite to the flow direction of said flowable food product so that the food ingredient is introduced into the flowable food product in an irregular and random pattern which does not intermix throughout the flowable food material after the flowable food material passes through the fill tube.

2. The method of claim 1 with flowing the flowing food product comprising flowing the flowable food product through the fill tube including a fill pipe and an injection tube extending from the fill pipe, with the supply rube extending through the injection tube and into the fill pipe.

3. The method of claim 2 with introducing the food ingredient comprising introducing the food ingredient through the supply tube which is generally liner straight and which has an end opening located generally adjacent to an inside surface of the fill tube.

4. The method of claim 3 with introducing the food ingredient comprising introducing the food ingredient through the supply tube which is generally vertical in the fill pipe.

5. The method of claim 1 with flowing the flowable food product comprising flowing a cultured dairy product through the fill tube.

6. The method of claim 5 with introducing the food ingredient comprising introducing the food ingredient being a carminic acid adjusted to a pH of below 12 and above 9.5.

7. The method of claim 5 with flowing the flowable food product comprising flowing yogurt through the fill tube; and with introducing the food ingredient comprising supplying the food ingredient in the form of dye, pigment or colorant.

8. The method of claim 7 with flowing the flowable food product comprising flowing yogurt having a viscosity of 8,000 to 40,000 cps at around 50° C.

9. The method of claim 1 with introducing the food ingredient comprising introducing the food ingredient into the flow of flowable food product in an irregular and random shape.

10. The method of claim 1 with introducing the food ingredient comprising providing the supply tube; and drilling the first duct in the supply tube at the acute angle.

11. The method of claim 10 with introducing the food ingredient comprising introducing the food ingredient into the flowing flowable food product in the fill tube through the entry point in the form of a second duct formed in the simply tube spaced axially from the free end of the supply tube, with the second duct extending at an acute angle in the annular wail of the supply tube and extending in the supply tube opposite to the flow direction.

12. The method of claim 11 with the second duct being spaced from the first duet in the flow direction, with all ducts formed in the supply tube being spaced from each other in the flow direction.

13. The method of claim 12 with the first and second being on opposite sides of the supply tube.

14. The method of claim 13 with the supply tube having an outside diameter wit the first duct being spaced from the free end generally eight times the outside diameter and the second duct being spaced from the free end generally ten times the outside diameter.

15. The method of claim 14 with the first and second ducts having a diameter in the order of one half of the outside diameter of the supply tube.

16. The method of claim 13 with the first and second ducts being in a same diametric plane.

17. The method of claim 16 with the acute angle of the first duct being equal to the acute angle of the second duct.

18. The method of claim 17 with the acute angle being 45°.

19. The method of claim 1 with introducing the food ingredient comprising introducing the food ingredient into the flowing flowable food product in the fill tube through the entry point in the form of a second duct formed in the supply tube spaced axially from the free end of the supply tube, with the second duct extending at an acute angle in the annular wall of the supply tube and extending in the supply tube opposite to the flow direction.

20. The method of claim 19 with the second duct being spaced from the first duct in the flow direction, with all ducts formed in the supply tube being spaced from each other in the flow direction.

21. The method of claim 20 with the first and second ducts being on opposite sides of the supply tube.

22. The method of claim 21 with the supply tube having an outside diameter with the first duct being spaced from the free end generally eight times the outside diameter and the second duct being spaced from the free end generally ten times the outside diameter.

23. The method of claim 22 with the first and second ducts having a diameter in the order of one half of the outside diameter of the supply tube.

24. The method of claim 23 with the first and second ducts being in a same diametric plane.

25. The method of claim 24 with the acute angle of the first duct being equal to the acute angle of the second duct.

26. The method of claim 25 with the acute angle being 45°.

27. The method of claim 19 with the first and second ducts being on opposite sides of the supply tube.

28. The method of claim 27 with the first and second ducts having a diameter in the order of one half of the outside diameter of the supply tube.

29. The method of claim 28 with the first and second ducts being in a same diametric plane.

30. The method of claim 29 with the acute angle of the first duct being equal to the acute angle of the second duct.

31. The method of claim 30 with the acute angle being 45°.

32. The method of claim 1 with the acute angle being 45°.

* * * * *